United States Patent [19]

Redshaw

[11] 4,031,703

[45] June 28, 1977

[54] SPHERICAL STIRLING ENGINE

[76] Inventor: Charles G. Redshaw, 15001 SE. 44th Place, Bellevue, Wash. 98006

[22] Filed: June 18, 1976

[21] Appl. No.: 697,624

Related U.S. Application Data

[63] Continuation-in-part of Ser. No. 602,923, Aug. 7, 1975, Pat. No. 3,984,981.

[52] U.S. Cl. ..... 60/519

[51] Int. Cl.[2] ..... F02G 1/04

[58] Field of Search ..... 60/517, 518, 519, 520, 60/525, 526

[56] References Cited

UNITED STATES PATENTS 3,815,362 6/1974 Kolbinger ..... 60/525

*Primary Examiner*—Allen M. Ostrager

[57] ABSTRACT

A Stirling cycle engine utilizing internal heat exchangers and heat regenerators. The engine is comprised of two wedge-shaped spherical sectors connected by a disk-like universal type coupling within a spherical housing to form four separate chambers. One sector is fixed relative to the housing while the other sector is nutated about the center of the assembly to vary the relative displacement of the chambers. The sectors, which are covered with heat conducting fins, serve as heat exchangers to transfer heat to or from a working fluid contained within the chambers. The coupling disk has two wedge-shaped spherical sectors mounted on each side, which are also covered with fins complementary to the heat exchanger sectors, and which contain passageways to connect the chambers on opposite sides to form two interconnected pair. The coupling sectors serve as heat regenerators to transfer heat to and from the working fluid as it is transferred from one interconnected chamber to the other.

10 Claims, 26 Drawing Figures

11A
10
40
30
9
5
60
13
C-2
80A
17
C-1
80
70
50
11B
20
21
22
23
81
4

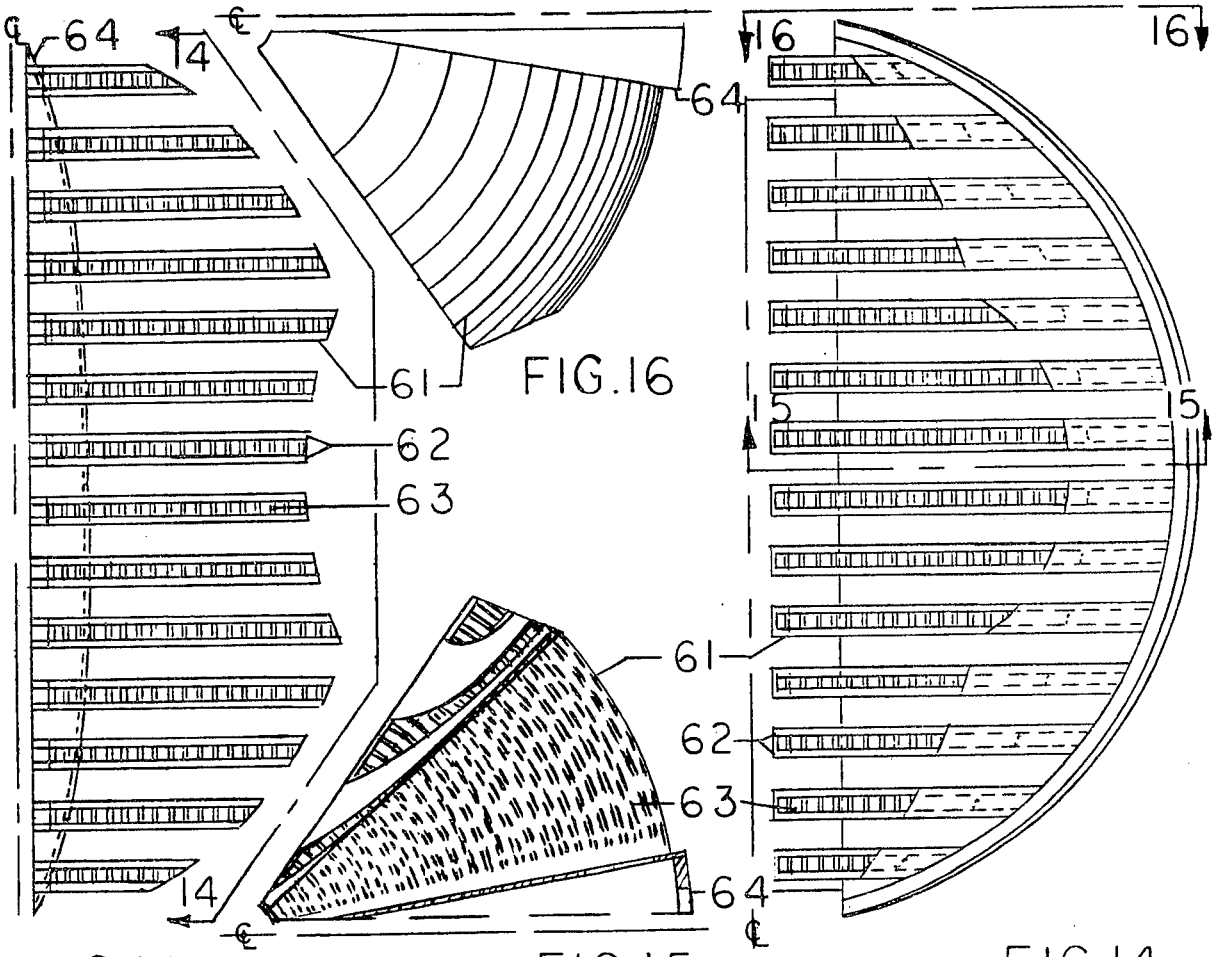
FIG.13 FIG.15 FIG.14
FIG.16
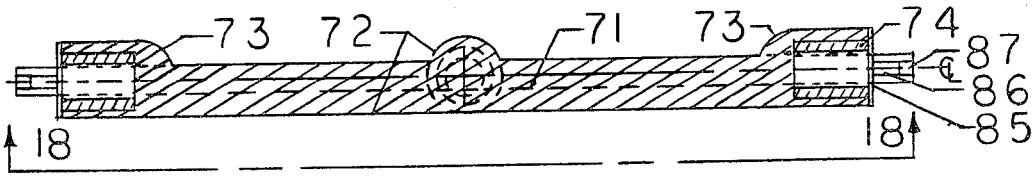
FIG.17
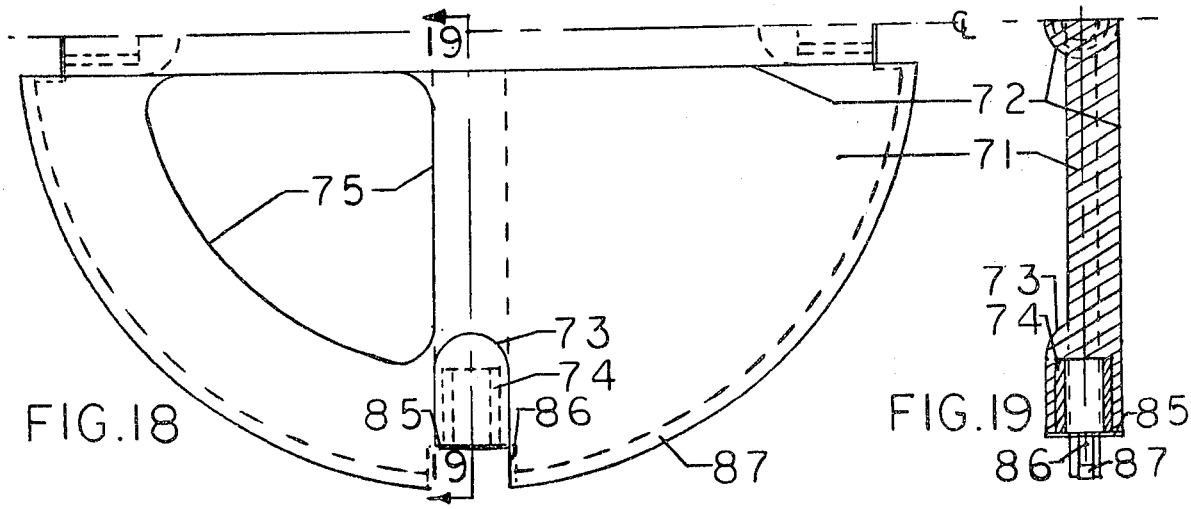
FIG.18 FIG.19

SPHERICAL STIRLING ENGINE

CROSS REFERENCE TO RELATED APPLICATIONS

This application is a continuation-in-part of parent U.S. patent appl. Ser. No. 602,923 filed Aug. 7, 1975, now U.S. Pat. No. 3,984,981.

BACKGROUND OF THE INVENTION

In my aforementioned related application, I disclosed and claimed a Stirling engine employing a universal coupling arrangement of internal heat exchangers and regenerators. The present invention carries forth the advantageous principals set forth in that earlier disclosure but differs in that a single nutator and crank combination are employed in place of the dual inclined rotors of the earlier case, while maintaining the same relative motion of the working elements. However, this invention is not to be limited to the use of a crank, and other means to provide rectangular, eliptical or other patterns in place of circular movement to the nutator, may be used to control the relative displacement of the chambers, allowing a variety of compression/expansion parameters.

Though the earlier configuration may be more suitable in certain applications, especially those requiring heat exchange from a remote low temperature source, the present configuration offers certain advantages in other applications, especially but not limited to, those using radiated, contained, or adjacent high temperature heat sources. Example of these latter applications are described hereinafter. The object of this invention is to further improve the effeciency power to weight ratio and cost of the prior concept for these applications.

SUMMARY OF THE INVENTION

The Stirling cycle engine of the present invention utilizes a variable displacement mechanism comprising two wedge-shaped spherical sectors connected with the wedge apexes at 90° to each other by a disk-like universal type coupling within a spherical housing to form four separate chambers. One sector is fixed relative to the housing, while the other sector is connected to a crank which moves it nutatively about the center of the assembly to vary the relative displacement of the chambers. The chambers are interconnected through passages in the coupling into two pair, in which the volume of each pair varies with the rotation of the crank 18° out of phase with the other, and each of the interconnected chambers varies 90° out of phase with the other The sectors serve as heat exchangers and are constructed with heat conducting fins to provide for the rapid transfer of heat to or from a working fluid contained within the chambers. The fins on the fixed sectors (high temperature heat exchanger) contain or are in direct communication with a high temperature heat source, while the movable sector (low temperature heat exchanger) and crank contain passageways for conducting a heat transfer fluid in exchange relationship with a low temperature heat sink. The coupling which is oscillated relative to the finned sectors is also constructed with fins on each side interspaced with the sector fins to complement the heat exchangers in transferring heat and displacing working fluid from one chamber to the other. The passages in the coupling and fins, which connect each chamber on the high temperature side of the coupling to a complementary one on the low temperature side, contain heat absorbing material which transfers heat to and from the working fluid, functioning as a heat regenerator.

Alternating expanding the working fluid in the high temperature side and compressing the fluid on the low temperature side of each pair of chambers will produce a net force on the crankpin to effect rotation of the crank. The basic engine may be modified to provide means for pressure regulation and containment of the engine working fluid, transmission of engine output, and control of the flow of heat to or from the heat exchangers.

DRAWING DESCRIPTION

Other features and advantages will be apparent from a study of the following drawings in which:

FIG. 13 is a side view of regenerator assembly in direction of view indicators 13—13 of FIG. 3

FIG. 14 is a front view of regenerator assembly in direction of view indicators 14—14 of FIG. 13.

FIG. 15 is a sectional view through regenerator assembly in direction of view indicators 15—15 of FIG. 14.

FIG. 16 is a top view of regenerator assembly in direction of view indicators 16—16 of FIG. 14.

FIG. 17 is a sectional view through disk assembly in direction of view indicators 17—17 of FIG. 3.

FIG. 18 is a half front view of disk assembly in direction of view indicators 18—18 of FIG. 17. Opposite half is same as half shown rotated 180°.

FIG. 19 is a half sectional view of disk assembly in direction of view indicators 19—19 of FIG. 18.

DETAILED DESCRIPTION

Figures 1, 2:
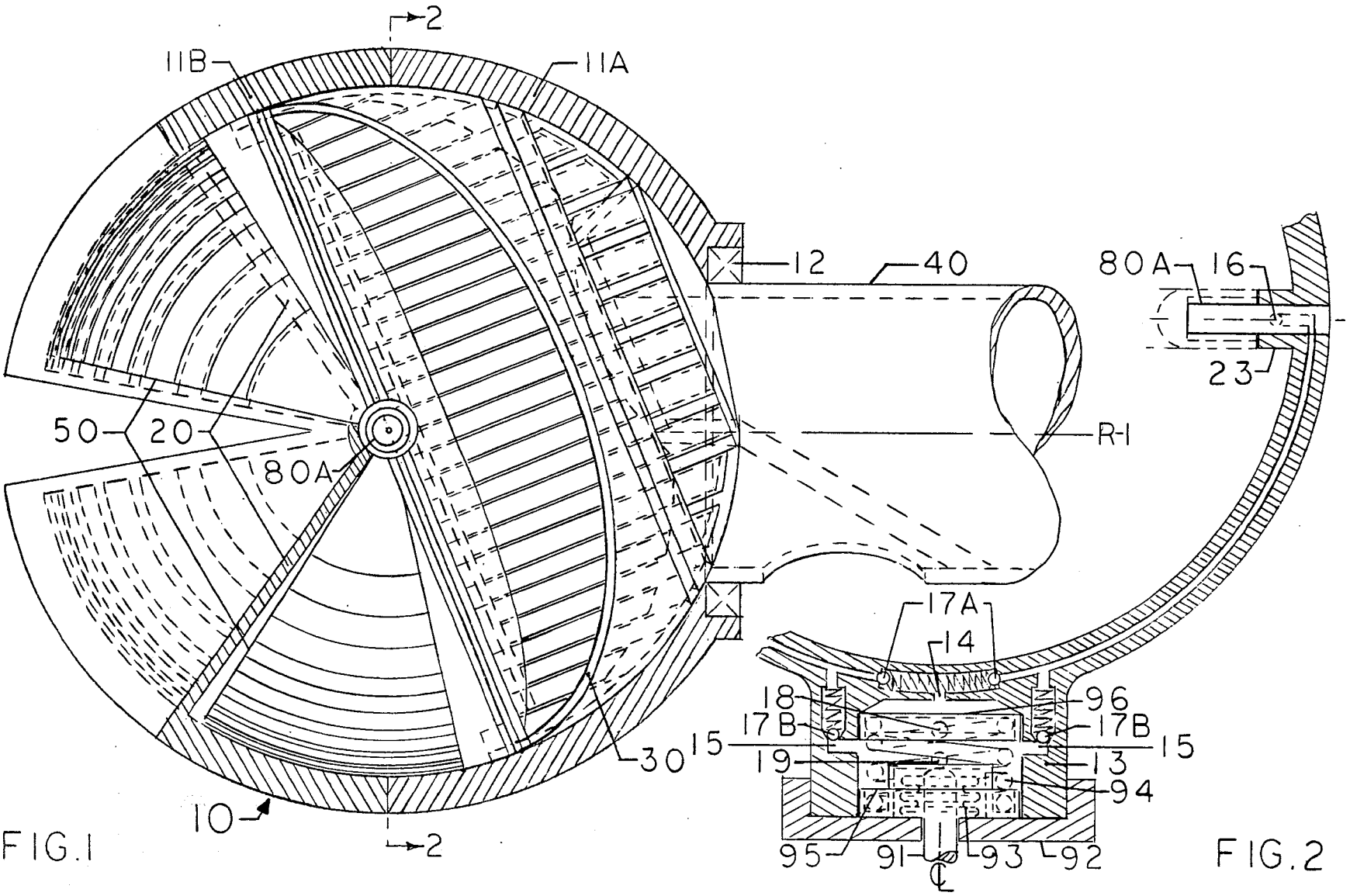
FIG. 1 is a side view of the basic engine taken parallel to the crackshaft centerline with the housing shown in section to allow exposure of the working elements. In the embodiment shown the fixed sector is an integral part of the housing and is also sectioned.
FIG. 2 is a partial sectional view of the housing in the direction of view indicators 2—2, showing in semi-schematic the working components of a pressure regulating valve added to the basic engine for control of working fluid pressure. Parts are symmetrical about centerline shown.
Figures 3, 4, 9:
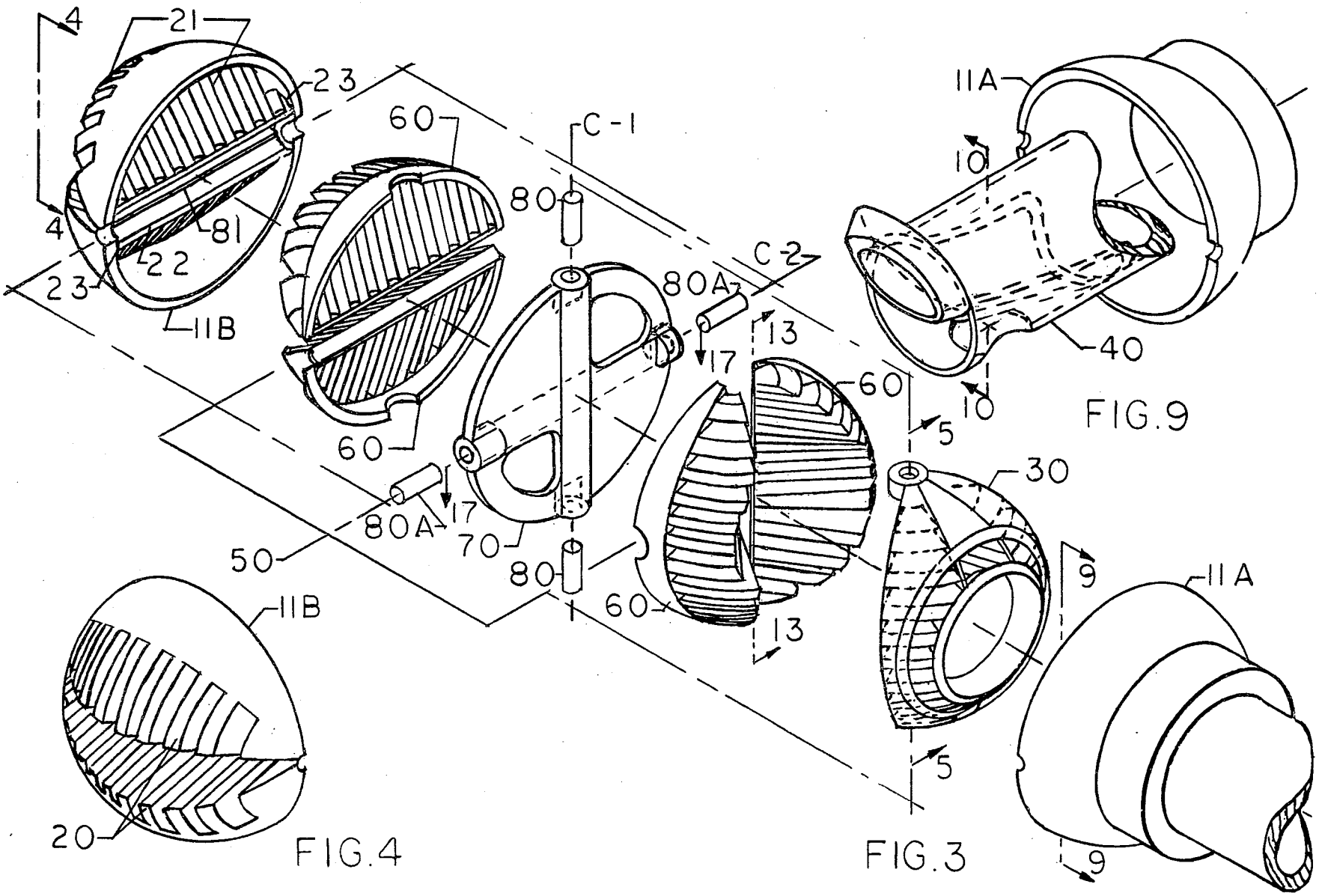
FIG. 3 is an exploded isometric view of the basic engine with the component orientation approximating FIG. 1.
FIG. 4 is an isometric view in the direction of view indicators 4—4 of FIG. 3, showing the fixed (high temperature) heat exchanger as an integral part of the housing.
FIG. 9 is an isometric view in the direction of view indicators 9—9 of FIG. 3, showing the ducted crank assembly.

Referring to the drawings, FIG. 1 shows the basic engine assembly 10. The primary housing means 11, of engine 10, consists of housing elements 11*a* and 11*b*, which are hemispherical in shape and joined along line 2—2 by conventional means (not shown) to effect a seal plane around the periphery of the join. The housing 11 contains the engine working elements comprising a fixed heat exchanger assembly 20, a moveable heat exchanger assembly 30, a crank assembly 40, and a coupling regenerator assembly 50, which is comprised of four similar spherical regenerator wedge-shaped assemblies 60, a coupling plate assembly 70 and two pair of coupling pins 80 and 80*a* (see FIG. 3). The crank assembly 40 is engaged with the moveable heat exchanger assembly 30, which is connected through the coupling-regenerator assembly 50 by coupling pins 80 and 80*a* to the fixed heat exchanger 20 to form a universal type coupling, so that rotating the crank assembly 40 will nutate the moveable heat exchanger assembly 30 and oscillate the coupling-regenerator assembly 50 about the center of the housing.

Inasmuch as the inner spherical surfaces of the housing elements 11*a* and 11*b* are wiped by seals on the moveable heat exchanger assembly 30 and coupling regenerator assembly 50, the seal contacting surfaces shall be ground and treated to effect a suitable seal plane. The crank assembly 40 is suitably journaled in support bearing 12 located in housing element 11*a* so that the shaft axis R-1 passes through the center of the sphere. The fixed heat exchanger assembly 20 may be constructed similar to the moveable heat exchanger assembly 30 and attached to a suitable opening in the housing element 11*b* by conventional means to effect a seal with the housing and prevent movement relative to the housing, or constructed as an integral part of the housing element as in the embodiment shown, depending on the need for fluid manifolds, (see FIGS. 1, 3 and 4). In either case, both heat exchangers have similar fin assemblies for the transfer of heat as described hereinafter. The fin assemblies 21 (FIG. 3) of the fixed heat exchanger assembly 20 are joined at the fin apex to form an open manifold between them. A semi-cylindrical groove 22, extending diametrically along the apex, and terminating at coupling pivot hubs 23 on each side of the housing, contains a strip seal 81, for engagement with a complementary journal segment on the coupling plate assembly 70.

Figures 5, 6, 7, 8:
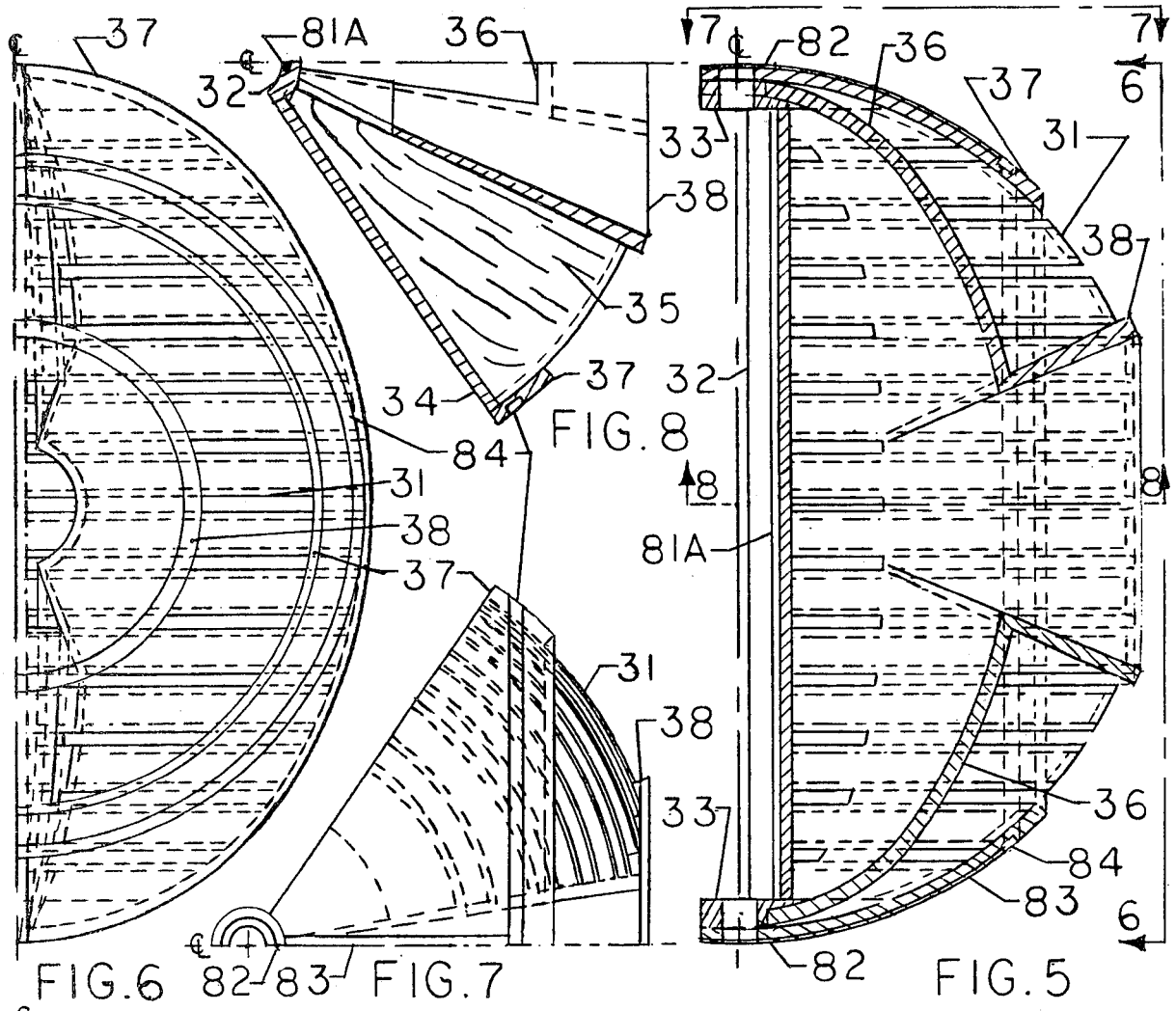
FIG. 5 is a sectional view of the movable (low temperature) heat exchanger assembly in direction of view indicators 5—5 of FIG. 3 showing transfer fluid manifolds and passages.
FIG. 6 is a half end view of the movable heat exchanger assembly in direction of view indicators 6—6 of FIG. 5. Part is symmetrical about centerline shown.
FIG. 7 is a half top view of the moveable heat exchanger assembly in direction of view indicators 7—7 of FIG. 5. Part is symmetrical about centerline shown.
FIG. 8 is a half sectional view of the moveable heat exchanger assembly in direction of view indicators 8—8 of FIG. 5. Part is symmetrical about centerline shown.

The fin assemblies 31 (FIG. 5) of the moveable heat exchangers 30 are similarly joined along the fin apex to form a manifold between them, and have a semi-cylindrical groove 32 extending diametrically along the apex between pivot hubs 33 containing strip seal 81*a*, for engagement with a journal segment on coupling plate assembly 70. The fin assemblies 31 are composed of a plurality of hollow thin-walled sector shaped fins 34, fabricated from heat conductive material supported internally with webbing 35, and having manifold openings for fluid circulation. The fin assemblies 31 are mounted on a fin support structure 36, which extends the length of the manifold terminating in a juxtaposition with fin stablizing cap 37, forming pivot hubs 33. Seals 82, 83 and 84 contained in cap 37, seal the moveable heat exchanger 30 against housing element 11*a*. The support structure 36 contains a conical bearing 38, which engages with the crank assembly 40, for the transmission of torque loads and heat conducting fluids through the assembly.

Figures 10, 11, 12:
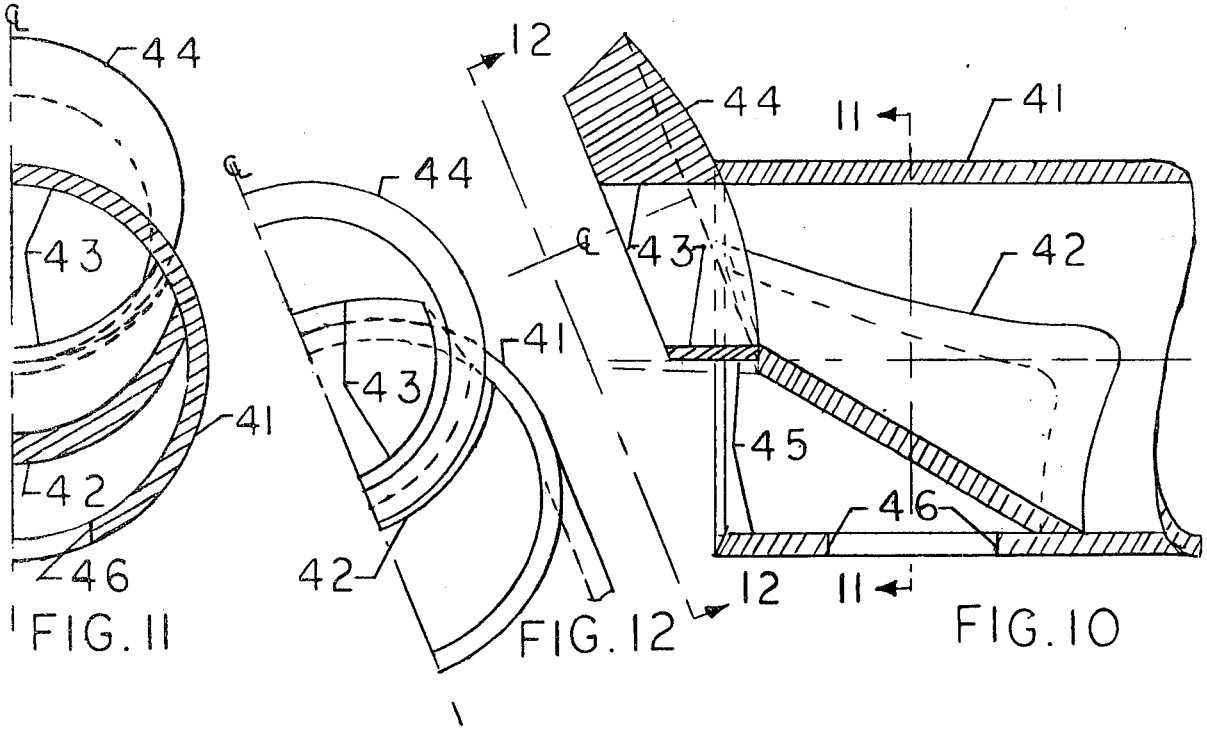
FIG. 10 is a sectional view of the crank assembly in the direction of view indicators 10—10 of FIG. 9 showing alignment of crankpin axis for nutative motion about housing center.
FIG. 11 is a half sectional view through crankshaft in direction of view indicators 11—11 of FIG. 10 showing orientation of fluid partition. Part is symmetrical about centerline shown.
FIG. 12 is a half end view of crankshaft in direction of view indicators 12—12 of FIG. 10 showing passages through crankpin and shaft. Part is symmetrical about centerline shown.

The crank assembly 40 (FIG. 9) contains fluid conducting passages. The support shaft 41 (FIGS. 10, 11 and 12) is hollow and contains a semi-cylindrical fluid divider 42, to direct fluid through passage 43 in crankpin 44, to the moving heat exchanger assembly 30, or from the exchanger through the shaft-end opening 45 and out shaft port 46. The crankpin 44 is conical in shape and attached to shaft 41 and divider 42, so that the cone centerline intersects the shaft centerline at the center of the engine housing.

The wedge-shaped regenerator assemblies 60 are composed of a plurality of thin sector shaped fins 61 (FIGS. 13, 14, 15 and 16), complementary in size and shape for interspacing with the heat exchanger fins. The fins are designed to maintain a uniform heat gradient across the sector to provide uniform heat transfer to or from the working fluid flowing through the fins. In the embodiment shown the fins are fabricated from a sandwich of low heat conductive side plates 62, containing a core of high heat absorbing material 63, in corrugated, strip, rod or ball shape, to allow fluid passage through the arc of the fin. However, the construction of the regenerator fins are not to be limited to this form. The fins 61 are mounted on a base 64 which has openings to distribute the flow through the fins, and the base 64 is joined to the coupling plate assembly 70 to form a manifold between them.

The coupling plate assembly 70 is fabricated from a circular disk 71 (FIGS. 17, 18 and 19) or heat insulating material having a semi-cylindrical journal segments 72, of a radius to match the heat exchanger grooves 22 and 32, extending diametrically across the disk on each side, displaced 90° to each other. The disk is notched at each journal end to accomodate the heat exchanger pivot hubs 23 and 33, and a boss 73 added to the opposite side of the journal segment providing for the installation of bushing 74, which accept coupling pins 80 and 80*a*. Seals 85, 86 and 87 are installed around the periphery of the assembly to provide sealing engagement with the heat exchanger hubs 23 and 33, and housing assembly 11. The regenerator assemblies 60 are located symmetrically on each side of each journal segment 72, with holes 75 located in disk 71 connecting the regenerator manifolds into two pair, forming the coupling-regenerator assembly 50.

Referring again to FIG. 3 the operation of the basic engine assembly 10 is described assuming heat is supplied to the fixed heat exchanger assembly 20 and cooling fluids circulated through the moving heat exchanger assembly 30 and crank assembly 40. Further assuming the 12 o'clock position of the crank as a reference point, the polar coordinates of the crankpin 44 will provide the vertical and horizontal components of the crankpin displacement.

With the crankpin 44 engaged with the heat exchanger bearing 38, the horizontal or sine component of the crankpin displacement will rotate the moveable exchanger assembly 30 about the vertical axis C-1 of the coupling plate assembly 70, varying the displacement of the chambers bound by the coupling plate assembly 70, moveable exchanger assembly 30 and housing 11*a*. Increasing the displacement of a chamber on one side of the exchanger 30 will decrease the displacement of the chamber on the opposite side so that the displacement of the chambers on each side (left and right) of the moving heat exchanger assembly 30 vary 180° out of phase with each other. Similarly, the vertical or cosine component of the crankpin displacement will rotate the combined assemblies of the moveable exchanger 30 and the coupling-regenerator assembly 50 about the horizontal axis C-2 of the coupling plate assembly 70, vary the displacement of the chambers bound by the coupling assembly 70, fixed heat exchanger assembly 20, and housing 11*b*. Also, the displacement of the chambers on each side (top and bottom) of the fixed heat exchanger assembly 20 will vary 180° out of phase with each other. It should be further noted, that inasmuch as the sine and cosine components of the crankpin displacement vary 90° out of phase with each other, the displacement of the chambers, on the fixed heat exchanger 20 side (far side) of the coupling assembly 70 will vary 90° out of phase with the displacement of the chambers on the moving heat exchanger assembly 30 side (near side) of the coupling assembly 70.

For clockwise rotation of the crankshaft assembly 40, the passages 75 through coupling plate 71, connect the chamber on the near right side of the coupling assembly 70 to the chamber on the far upper side, and connect the chamber on the near left side to the chamber on the far lower side. Thus it can be appreciated that the 90° phase difference in the displacement of the interconnected chambers will cause fluid to be displaced from one chamber to the other, and that it can be further appreciated that the displacement of the chambers on the near side of the coupling plate assembly 70 will lag the displacement of the chamber on the far side by the 90° phase difference causing the majority of the fluid in a connected pair of chambers to be located on the far side when their conbined displacement is increasing, and to be located on the near side when their conbined displacement is decreasing. The combined displacement of the near right and far upper chambers will become minimum at a crank displacement angle of 45° from the referenced position, with fluid flow through the regenerators from the near side towards the far side, and become maximum at a rank displacement angle of 225°, with fluid flow through the regenerators from the far side towards the near side. Similarly the combined displacement of the opposing near left and far lower chambers operating 180° out of phase with the former pair, will become maximum at 45° from the referenced position, and minimum at 225°. The transfer of heat, from the fixed heat exchanger assembly 20 and heat regenerator assemblies 60 to the fluid contained in the chambers during expansion of the fluid, and from the fluid to the moving heat exchanger assembly 30 and regenerator assemblies 60 during compression of the fluid, will cause the means effective pressure during expansion to exceed the mean effective pressure during compression for each pair of chambers working 180° out of phase with each other, producing a net clockwise torque effect on the crank assembly 40.

The quantity of working fluid contained in the engine chambers is one parameter affecting engine output, and can be controlled by regulating the engine operating pressure limits. A preferred embodiment of an engine pressure regulating valve is shown in FIG. 2. The housing elements 11*a* and 11*b* contain an integral valve chamber 13, which is connected by integral passageways from a valve inlet port 14 and valve outlet ports 15 around the periphery of the housing join to pressure sensing ports 16 located on coupling pivot hubs 23. Check valves 17 and 17*a* located in the passageways prevent reverse or crossflow between the ports. Suitably spaced differential pressure port 18 and reference pressure port 19 connect the valve to a fluid reference pressure reservoir. A pressure control rod 91 slidably mounted in an enclosure cover 92 and sealed by bellows 93, varies the compression of a differential pressure spring 94, tjhrough the positioning of a spring retaining cup 95 to position valve piston 96.

As the engine is motored and the displacement of the chambers varies, the corresponding pressure variations will be sensed at the respective pressure sensing ports 16 for each pair. The maximum pressure sensed is trapped by check valves 17 and applied through the valve inlet port 14 to the valve piston 96. When the maximum pressure sensed is in equilibrium with the reference pressure sensed through port 19 plus the pressure due to the force of differential spring 94, the valve piston 96 will cover differential pressure port 18 and valve outlet port 15, preventing any flow of working fluid in or out of the engine. Applying pressure to control rod 91 will increase the force on the piston due to the differential spring 94 moving the valve piston 96 to open valve port 15. If the minimum pressure sensed at port 16 is below the reference pressure, working fluid will enter the engine through check valves 17*a* raising the engine operating pressures until the maximum pressure sensed repositions valve piston 96 to close valve port 15, or until the minimum pressure is equal to the reference pressure and the engine maximum differential pressure is reached. Similarly releasing pressure on the control rod 91 will move valve piston 96 to uncover differential pressure port 18 allowing working fluid to flow from the engine, lowering the engine operating pressures until the lower maximum pressure sensed repositions valve piston 96 to close port 18, or until the maximum pressure is equal to the reference pressure and the engine minimum differential pressure is reached.

Although minor seal leakage is inconsequential to engine operation due to automatic pressure regulation and distribution, seal leakage between the low temperature heat exchanger 30 and housing 11*a* would limit the working fluid to an expandable supply such as air, and limit the working pressures to a fairly low range. Non-recirculation of heat transfer fluids through the low temperature exchanger 30 would also limit the cooling fluid to an expendable fluid such as air. Engine effeciency and performance would be improved by adding a secondary housing extending from the primary housing to contain a common fluid for both working and heat transfer functions, having improved characteristics, pressurized to increase the engine reference pressure, and with means of fluid circulation for heat transfer. Two configurations of extended housings are shown in FIGS. 20, 21, 22 and 23.

Figure 21:
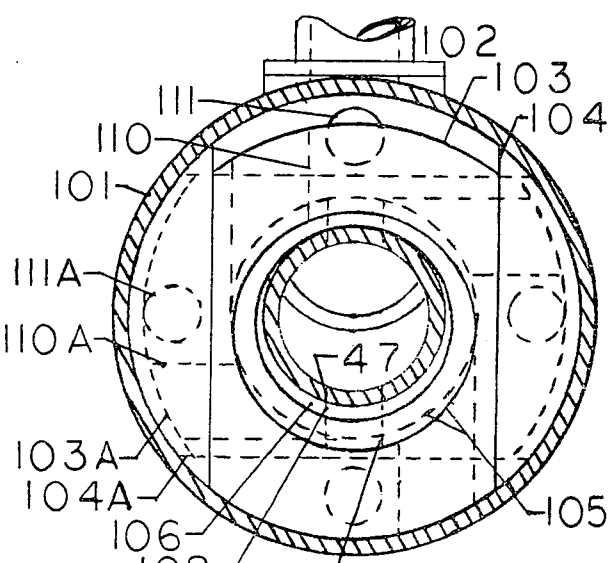
FIG. 21 is a sectional view in the direction of view indicators 21—21 of FIG. 20, showing two double acting pistons located at right angles to each other and driven by twin eccentrics mounted on the engine crank shaft.
Figure 23:
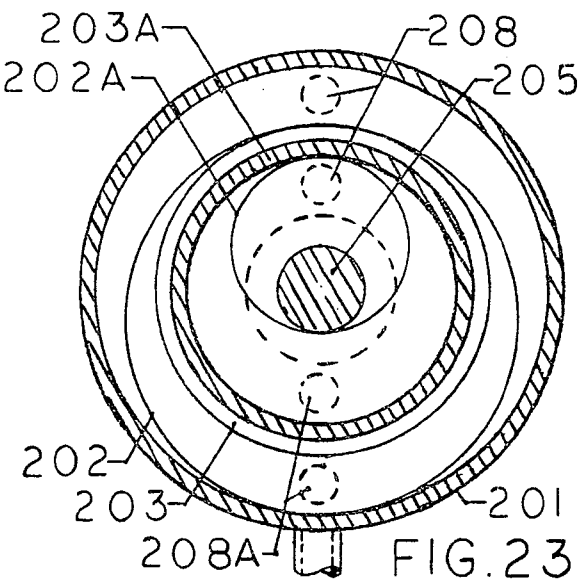
FIG. 23 is a sectional view in direction of view indicators 23—23 of FIG. 22, showing thread intersection of helical diaphragms on indicator plane, illustrating separation of heat exchange fluids.
Figure 20:
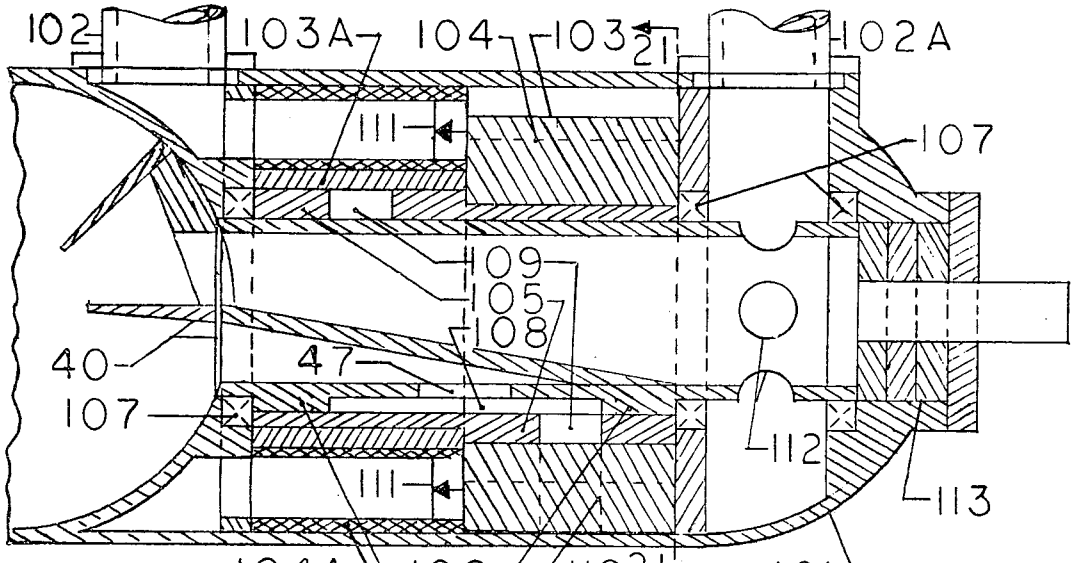
FIG. 20 is a partial sectional view in the same plane as FIG. 1, showing in semi-schematic an extended housing and positive displacement pump for the containment and circulation of heat transfer fluids through an external heat exchanger.
Figure 22:
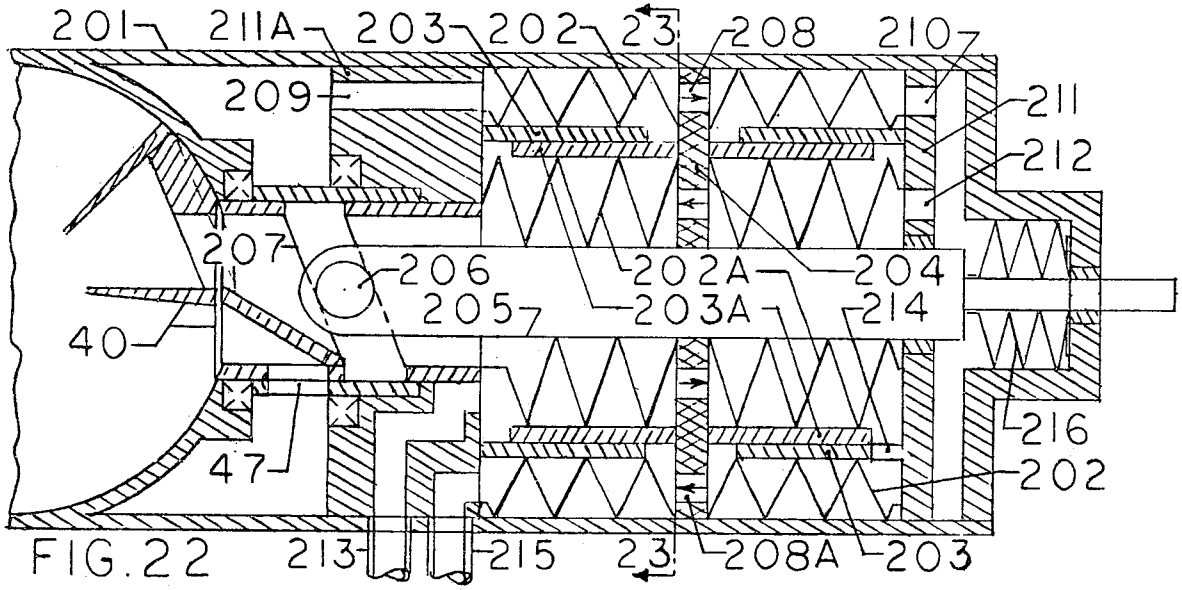
FIG. 22 is a partial sectional view in the same plane as FIG. 1, showing in semi-schematic an extended housing and dual double acting fluid pumps for the containment and circulation of heat transfer fluids through an internal heat exchanger.

In the arrangement shown in FIGS. 20 and 21, the housing extension 101 contains a positive displacement pump which circulates the fluid through an external heat exchanger connected to housing ports 102 and 102*a*. The pump configuration which uses dry lubricants has an enertial system similar to the basic engine, and may be oriented and weighted to effectively neutralize engine vibrations for certain applications. The pump is comprised of two double acting pistons 103 and 103*a*, located at 90° to each other between piston guides 104 and 104*a*, driven by twin piston eccentrics 105 mounted on crank eccentric 106 attached to shaft 41 of crank assembly 40 supported by bearings 107. Fluid circulated through the low temperature heat exchanger 30 is directed through outlet 47 in crank assembly 40, passages 108 in crank eccentric 106, and passage 109 in piston eccentric 105, which moving in opposite rotation alternately connect with passages 110 in pistons 104 and 104*a*. The slots are disconnected at the maximum chamber position and as the piston moves to compress the fluid, the fluid is forced through check valves 111 or 111*a* to housing outlet 102 and to the external heat exchanger. Fluid from the external heat exchanger is returned through housing inlet 102*a* and holes 112 in the crank assembly 40 to the internal heat exchanger. The crank shaft may be extended through a conventional seal chamber 113 as shown for direct coupling of engine output or coupled indirectly by further extending the housing to include mechanical, electrical or hydraulic coupling means to effect a positive seal.

The danger of exposing light flammable gases such as hydrogen working fluid under high temperatures and pressures in external heat exchangers may be avoided by arranging the engine output in hydraulic form and utilizing the pumped fluid as a heat sink. In the arrangement shown in FIGS. 22 and 23, the housing extension 210 contains a dual fluid double acting pump which is used as a heat exchanger between the pumped fluids. The pump is comprised of two pair of concentric helical diaphragms 202 and 202*a*, separated by tubular spacers 203 and 203*a* and connected to each side of a displacer plate 204 mounted on an actuating shaft 205 which is actuated by cam pin 206 riding in cam 207 attached to crank assembly 40. The actuative movement of the displacer plate 204 alternately extends and compresses the helical diaphragms 202 and 202*a*, forcing fluid trapped by check valves 208 in displacer plate 204, to flow along the helical thread in a reverse flow relationship and effecting heat exchange through the diaphragm walls. Fluid circulated through the low temperature heat exchanger 30 is directed through the outlet 47 in crank assembly 40 to pump inlet 209, along the helical thread between the diaphragm 202 and housing 210 to opening 210 in diaphragm support plate 211. The fluid is returned to the heat exchanger assembly 30 through pump opening 212 along the helical thread between the diaphragm 202*a* and actuating shaft 205 to inlet of crank assembly 40. Similarly cooling fluids entering housing connection 213 flows along the inner helical thread between diaphragm 202*a* and spacer 203*a* to opening 214 and returned along the outer helical thread between diaphragm 202 and spacer 203 to pump outlet 215. The actuating shaft 205 may be extended through housing diaphragm seal 216 for direct mechanical coupling of the engine output.

Figures 24, 25, 26:
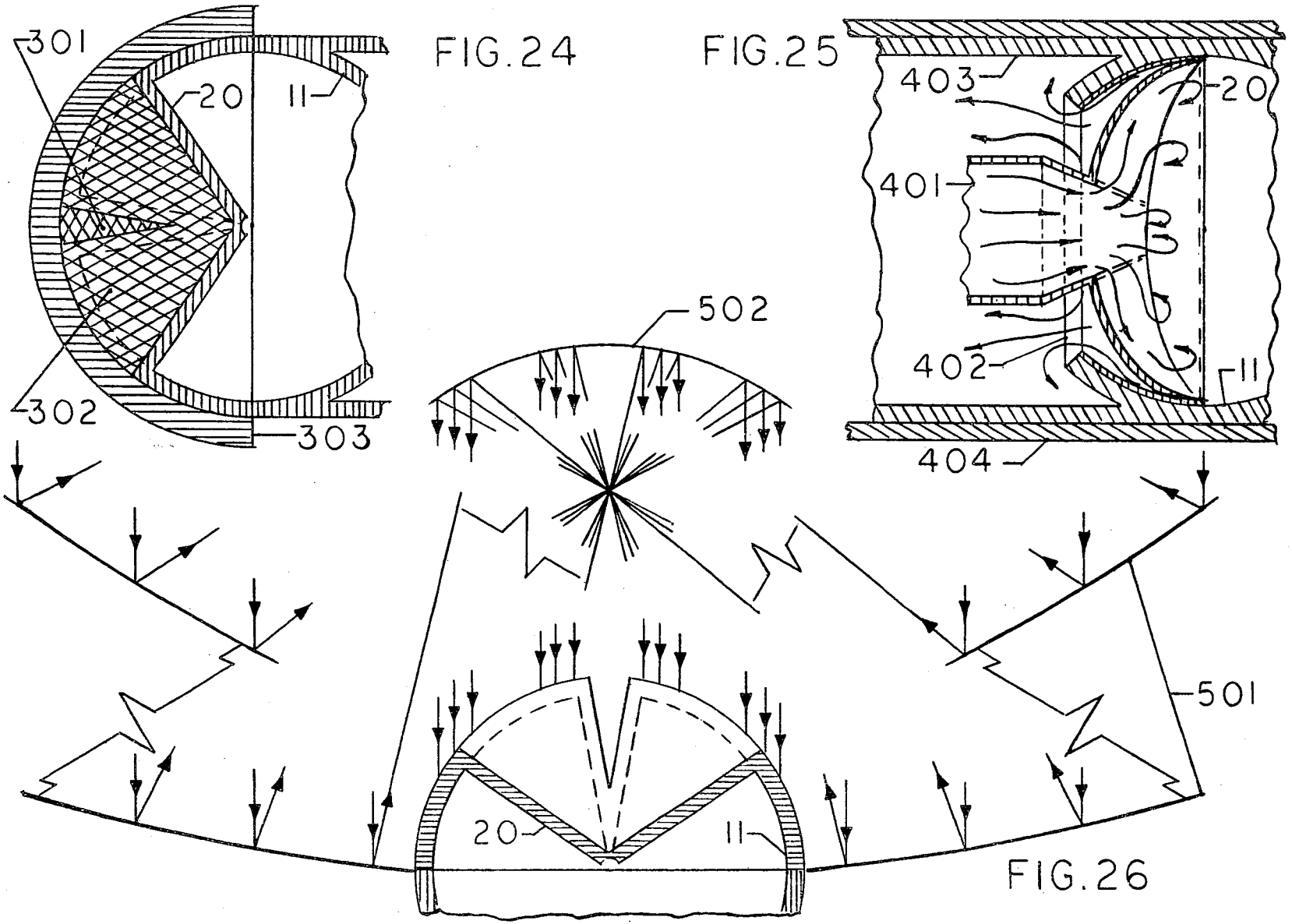
FIG. 24 is a partial sectional view in the same plane as FIG. 1, showing in semi-schematic a contained heat source within the fixed (high temperature) heat exchanger.
FIG. 25 is a partial sectional view in a plane 90° to FIG. 1, showing in semi-schematic an extended housing for use with an adjoining regenerative combustion chamber, and using a manifold fixed (high temperature) heat exchanger of similar construction to the moveable (low temperature) heat exchanger.
FIG. 26 is a partial sectional view in the same plane as FIG. 1, showing in semi-schematic an engine housing located at the center of a radiant heat collector using a focusing reflector to direct heat over the exposed fixed heat exchanger fins and housing. Long break lines are used to compress the collector and reflector into the figure.

Three methods of supplying heat to the high temperature heat exchanger are shown in FIGS. 24, 25 and 26. In the arrangement shown in FIG. 24, heat is supplied from a central core of radioisotope material 301 surrounded by thermal storage material 302, contained within the high temperature heat exchanger assembly 20 shown as an integral part of the engine housing 11*b*, and enclosed by cover 303 to contain the radiation and heat within the engine. Heat absorbed by the thermal storage material 302 during low heat demand is available for peak engine loads. In the arrangement shown in FIG. 25, heat is supplied from fluids circulated through the high temperature heat exchanger 20, shown with a central manifold inlet 401 and surrounding circular outlet 402, similar in construction to the moving low temperature heat exchanger assembly 20 (see FIG. 3). A secondary housing 403, enclosed by insulating material 404, may be added extending from the primary housing 11*b* to contain an adjacent combustion chamber and regenerator for the production of high temperature fluids. In the arrangement shown in FIG. 26, heat is supplied from a remote source by radiation. The engine 10 is located in the center of a radiant heat collector 501 which focuses the heat rays onto reflector 502, which then directs them onto the exposed high temperature heat part of the engine housing 11*b* and heat exchanger 20, shown as an integral part of the engine housing. In certain applications, the remote side of collector 501 may be utilized as a radiator to dissipate heat from the engine.

Obviously a complete installation may use any of the foregoing heat source and heat dissipation arrangements in combination or conjunction with variations in engine coupling to meet specific installation objectives. Also the angles subtended by the fin sectors and connecting manifolds are related to the crankpin offset angle and are design variables depending on fluid flow and heat transfer requirements. The configuration shown provides for exchanger and regenerator fin angles of 45°, crankpin offset angle of 22½°, manifold angles of 10° for each fin set, with a fin clearance angle of 2½ between them, although the engine may be configured with other values. The design parameters affecting engine performance and operating efficiency are essentially the same as that shown in the referenced related application. However, the engine embodiments of this invention offer considerable simplification, and in some instances are more applicable than the earlier related configurations. What is new and desired to be secured by Letters Patent is described in the following claims.

I claim:

1. A spherical Stirling cycle engine having means for internal heat transfer comprising:

a housing fixed against rotation comprising;

two substantially hemispherical members having means for joining and sealing around their common diametrical plane forming an essentially spherical cavity, said members each having a circular aperture located diametrically opposite each other;

a circular disk located within said cavity and engaged with said housing by sealing means to divide said cavity into two substantially equal first and second sections, said disk having a first axis with a journal segment extending diametrically across the disk in said first section, and a second axis positioned perpendicular to said first axis with a journal segment extending diametrically across the disk in said second section;

substantially similar first and second spherical-sector shaped heat exchangers located in said first and second sections respectively, and pivotally mounted about said first and second axis to form a universal coupling between them, with the wedge apex engaged by seal means to said journal segments and the wedge lune juxtapose and engaged by seal means to said housing, dividing each of said sections into two chambers, said heat exchangers having ports located on the wedge lune in communication with said apertures for the circulation of heat transfer fluids through heat exchanger fin assemblies comprising;

a plurality of hollow sector shaped fins arranged symmetrically to form a spherical-sector shape with openings on common manifolds connected to said ports;

atachment means to prevent movement of said first heat exchanger, located in said first section, relative to said housing;

connective means for drivingly engaging said second heat exchanger for nutative movement, said movement providing an oscillating motion to said second heat exchanger about said second axis varying the effective volume of said chambers in said second section, and an oscillating motion to said disk about said first axis varying the effective volume of said chambers in said first section;

substantially similar spherical-sector shaped heat regenerators located within each said chamber by attachment means to said disk, and connected by passages through said disk between said first and second sections to form two interconnected pair of chambers, said regenerators comprising;

a plurality of sector shaped fins arranged for interspacing with said heat exchanger fin assemblies, and mounted on a common manifold to form a spherical-sector shape, said fins providing fluid passage in heat exchange relationship with a working fluid circulated between said interconnected chambers through said manifolds and passages;

means for supplying heat to said first heat exchanger;

means for removing heat from said second heat exchanger.

2. The spherical engine as defined in claim 1 wherein:

means for supplying heat to said first heat exchanger is provided by means ducting high temperature fluids from a remote source to said aperture of said first section for circulation through said manifold ports and fin assemblies.

3. The spherical engine as defined in claim 2 wherein:

the source of high temperature fluids is provided by adding a secondary housing extending from said first section housing, to contain means of generating and circulating high temperature fluids from combustion.

4. The spherical engine as defined in claim 1 wherein:

means for supplying heat to said first heat exchangers is provided by radiation from a remote source focused by reflective means on said first section housing, said first section aperture being extended and said fluid manifolds being omitted to expose said heat exchanger fin assemblies to said radiation.

5. The spherical engine as defined in claim 1 wherein:

the means for supplying heat to said first heat exchanger is provided by radioisotope and/or thermal storage material located within said heat exchanger suitable modified or extended for the containment of said materials.

6. The spherical engine as defined in claim 1 wherein:

connective means for drivingly engaging said second heat exchanger is provided by a crankshaft extending through said second section aperture, rotatably supported by bearing means in said housing, said crankshaft supporting a crankpin offset to said crankshaft axis with the crankpin axis inclined to intersect the shaft axis at the center of said engine cavity, said crankpin being rotatably mounted in said second heat exchanger by bearing means.

7. The spherical engine as defined in claim 6 wherein:

means for removing heat from said second heat exchanger is provided by conducting cooling heat-transfer fluids from a remote source through passageways in said crankshaft and crankpin to said second heat exchanger manifold ports for circulation through said fin assemblies.

8. The spherical engine as defined in claim 1 wherein:

the amount of fluid contained within said housiing is regulated by a valve system comprising;

a valve housing containing valve inlet and outlet ports connected by means defining passageways to engine ports located on said first axis pivot means and reference pressure inlet and outlet ports connected to a reference pressure reservoir;

valve means located in said passageways to allow fluid flow only to said valve inlet port and only from said valve outlet port;

valve means located in said valve housing to allow fluid flow from said reservoir to said engine ports only when fluid pressure sensed by said engine port is less than the reference pressure plus a control spring bias pressure, and to allow fluid flow from said engine port to said reservoir only when fluid pressure sensed by said engine port is more than the reference pressure plus said control spring bias pressure, and to stop fluid flow between said engine and reference ports when the pressure sensed at said engine ports is in equilibrium with said reference pressure plus said bias pressure;

actuating means to reposition said conrol spring to vary said equilibrium pressure.

9. The spherical engine as defined in claim 7 wherein:

means of containing and recirculation pressurized engine fluids for use with an external heat exchanger is provided by adding a secondary housing extending from said engine housing and enclosing said crankshaft, said secondary housing having;

bearing means positioned for rotatably supporting said crankshaft;

duct connections suitably located for routing of heat transfer fluids to external heat exchangers;

valve means for charging or relieving fluids into or from said housing to enable setting fluid pressure within said housing;

a positive displacement pump operated by means attached to said crankshaft and connected by passage means to provide fluid circulation through said second heat exchanger;

a seal chamber coaxial with the centerline of said crankshaft through which a shaft extension for the transmission of engine output is sealed.

10. The spherical engine as defined in claim 7 wherein:

means for containing and recirculating pressurized engine fluids for use with an internal heat exchanger is provided by adding a secondary housing extending from said engine housing and enclosing said crankshaft, said secondary housing having;

bearing means for rotatably supporting said crankshaft;

an internal heat exchanger including housing duct connections suitably located for routing of secondary heat transfer fluids to said internal heat exchanger;

valve means for charging or relieving primary heat transfer fluids into or from said housing to enable setting fluid pressure within said housing;

a positive displacement pump operated by means attached to said crankshaft and connected by passage means to provide circulation of primary heat transfer fluid through said engine second heat exchanger and said internal heat exchanger, and circulation of said secondary heat transfer fluid through said internal heat exchanger in heat exchange relationship between said primary and secondary heat transfer fluids;

a seal chamber coaxial with the centerline of said crankshaft through which a shaft extension for the transmission of engine output is sealed.

* * * * *